US009146070B2

(12) United States Patent
Langley

(10) Patent No.: US 9,146,070 B2
(45) Date of Patent: Sep. 29, 2015

(54) MODULAR ADJUSTABLE CAM STOP ARRANGEMENT

(71) Applicant: Timothy Langley, Newburgh, IN (US)

(72) Inventor: Timothy Langley, Newburgh, IN (US)

(73) Assignee: Bear Archery, Inc., Evansville, IN (US)

( * ) Notice: Subject to any disclaimer, the term of this patent is extended or adjusted under 35 U.S.C. 154(b) by 414 days.

(21) Appl. No.: 13/621,430

(22) Filed: Sep. 17, 2012

(65) Prior Publication Data

US 2013/0068206 A1 Mar. 21, 2013

Related U.S. Application Data

(60) Provisional application No. 61/536,630, filed on Sep. 20, 2011.

(51) Int. Cl.
*F41B 5/10* (2006.01)
*F41B 5/14* (2006.01)

(52) U.S. Cl.
CPC ..... *F41B 5/105* (2013.01); *F41B 5/1434* (2013.01)

(58) Field of Classification Search
CPC ..... F41B 5/105; F01L 1/047; F01L 1/08; F01L 1/04
See application file for complete search history.

(56) References Cited

U.S. PATENT DOCUMENTS 4,562,824 A 1/1986 Jennings
5,791,323 A 8/1998 Dunlap
5,960,778 A 10/1999 Larson
6,082,346 A 7/2000 Andrews et al.
6,082,347 A 7/2000 Darlington
6,250,293 B1 6/2001 Andrews
6,360,735 B1 3/2002 Larson et al.
6,575,153 B2 6/2003 Lommasson et al.
6,691,692 B1 2/2004 Adkins
6,871,643 B2 3/2005 Cooper et al.
6,976,484 B1 12/2005 Gallops, Jr.
6,994,079 B1 2/2006 Darlington
7,082,937 B1 8/2006 Land
7,188,615 B2 3/2007 Chang
7,305,979 B1 12/2007 Yehle
7,311,098 B2 12/2007 Gallops, Jr.
7,690,372 B2 4/2010 Cooper et al.
7,721,721 B1 * 5/2010 Kronengold et al. ..... 124/25.6
7,997,259 B2 8/2011 Wilson
2006/0174859 A1 8/2006 Andrews
2009/0288650 A1 11/2009 Batdorf
2011/0023857 A1 2/2011 Grace

* cited by examiner

*Primary Examiner* — Melba Bumgarner
*Assistant Examiner* — Amir Klayman
(74) *Attorney, Agent, or Firm* — Woodard, Emhardt, Moriarty, McNett & Henry LLP

(57) ABSTRACT

Embodiments of the present disclosure include a two piece modular draw stop system for an archery bow cam including a positioner piece and an abutment piece. The positioner piece defines a groove for a power cable of the archery bow and is arranged on the cam to present the power cable toward the abutment piece upon rotation of the cam. The abutment piece is configured to abut the power cable to impede further rotation of the cam. The abutment piece may be reversible to allow different draw lengths of the bowstring at a selected mounting location.

18 Claims, 9 Drawing Sheets

MODULAR ADJUSTABLE CAM STOP ARRANGEMENT

CROSS-REFERENCE TO RELATED APPLICATIONS

This application claims the benefit of U.S. Provisional Application Ser. No. 61/536,630, filed Sep. 20, 2011, which is hereby incorporated by reference in its entirety.

FIELD OF THE INVENTION

Aspects of the present invention deal with archery bows, and in particular deal with a modular adjustable cam stop arrangement usable with archery bows.

BACKGROUND OF THE INVENTION

The present invention deals primarily with compound archery bows, generally including a bow frame and a cable system on the frame mounted to at least two rotational elements such as wheels or cams. The draw length of a bow can be controlled by positioning a "stop" which prevents drawing of the bow past a certain point. The stop is typically a portion of the cam which abuts the cable arrangement at a certain rotational point and prevents further rotation. The draw length of the bow can be adjusted by adjusting the position of the stop on the cam. Certain prior bows use one-piece modules of different sizes or a pivotal module to set the draw length.

An improved bow and cam stop arrangement is desired.

SUMMARY OF THE INVENTION

In certain embodiments of the present disclosure, an archery bow includes a reversible draw stop piece mounted to a cam. The draw stop piece is configured to abut a power cable when the cam has rotated a preselected amount to impede further rotation. The reversible draw stop piece includes first and second mounting surfaces mountable facing the cam, with the piece defining two different draw lengths of the bowstring based on which mounting surface is facing the cam. Additionally, the cam may define a plurality of preselected mounting locations at which the draw stop piece may be mounted, each location corresponding to two draw lengths of the bowstring defined by the draw stop piece.

In other embodiments of the present disclosure, a cam stop system includes an inner cable positioning piece and an outer abutment piece. The inner piece defining a groove arrangeable to present a power cable toward the outer piece upon rotation of the cam. The outer piece is configured to engage the power cable of the archery bow to limit the maximum draw length of the bowstring. Additionally, the outer piece is reversible on the cam with first and second mounting sides corresponding to first and second maximum draw lengths of the bowstring.

It is an object of certain preferred embodiments herein to provide an improved archery bow and cam stop arrangement.

Additional objects and advantages of the described embodiments are apparent from the discussions and drawings herein.

DESCRIPTION OF PREFERRED EMBODIMENTS

Figure 1:
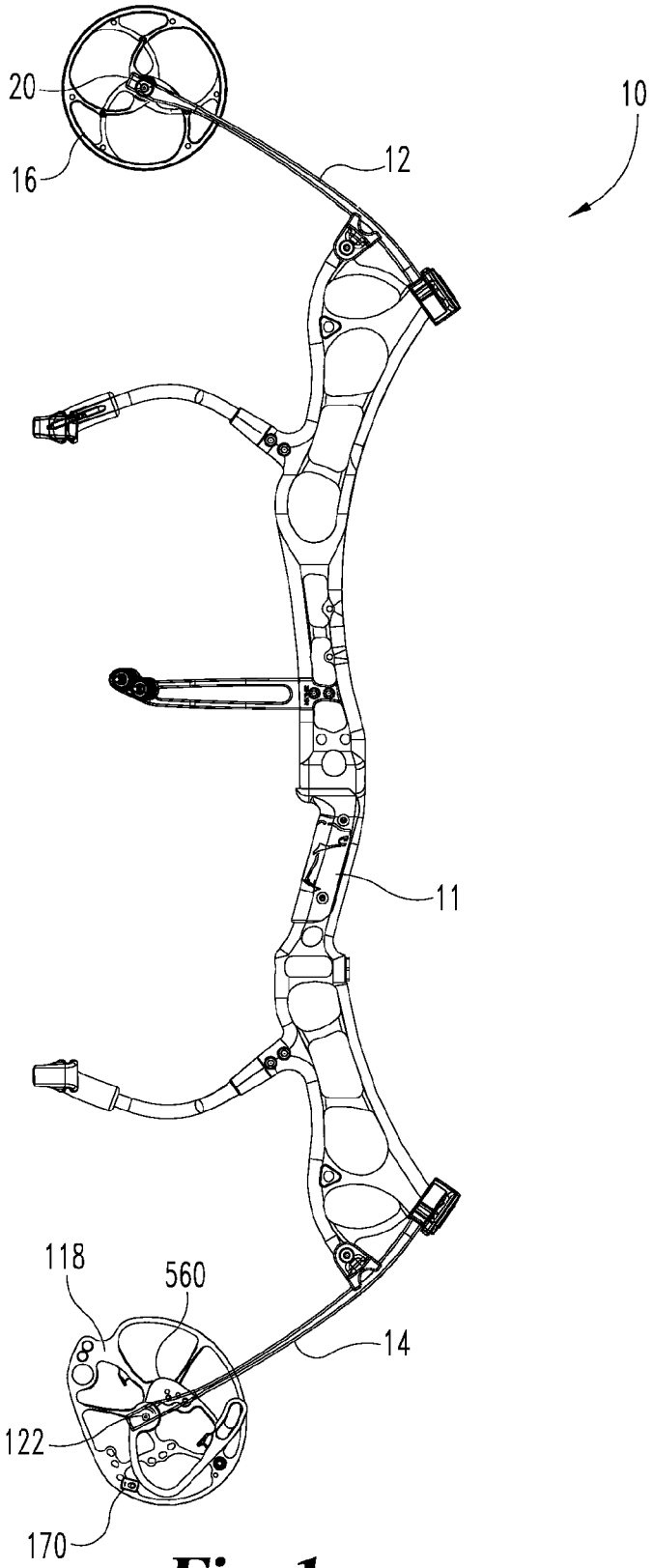
FIG. 1 is a perspective view of an archery bow including an embodiment of a cam assembly as disclosed herein.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

In certain embodiments, the present disclosure is directed to embodiments of a draw stop system for an archery bow cam, the system including an optional positioner piece and an abutment (or draw stop) piece. The abutment piece is configured to abut a power cable of the archery bow to impede further rotation of the cam and thereby limit the draw length of a bowstring of the archery bow. As shown in illustrated embodiments, the abutment piece may be reversible, having first and second mounting sides which can selectively engage the cam. The abutment piece is reversible insofar as when one mounting side is facing the cam, the piece allows one bowstring draw length; however, if the other mounting side is facing the cam, a different bowstring draw length is allowed. In certain embodiments, the abutment piece may include non-symmetric mounting lugs to engage one of various mounting points along the cam. Further, the abutment piece may be selectively mounted at different mounting locations along the cam, creating a modular system which allows for two different bowstring draw lengths at each location. The positioner piece may be used to present the power cable toward the abutment piece upon rotation of the cam. Additionally, the length of the groove in the positioner piece assists in defining the amount of rotation allowed by the system.

FIG. 1 illustrates one example of a conventional single cam compound archery bow, generally designated as 10, with which the presently-disclosed draw stop systems may be used. When viewed from the perspective of an archer holding the bow 10, it includes a riser 11 with a handle and an arrow rest, an upper limb portion 12 and a lower limb portion 14. Rotational members forming one or two variable leverage units such as the illustrated idler wheel 16 and eccentric cam 118 are supported at the limb tip sections for rotary movement about axles 20 and 122. Idler wheel 16 is carried between the outer limb tip portions of upper limb 12. The cam 118 is carried between the outer limb tip portions of lower limb 14.

A bowstring (not shown in FIG. 1) typically includes an upper end and a lower end which are fed-out from idler wheel 16 and cam 118 when the bow is drawn. The bowstring is mounted around idler wheel 16 and cam 118 as is known in the art. From the perspective of the archer, the bowstring is considered rearward relative to the riser which defines forward.

When the bowstring is drawn, it causes idler wheel 16 and cam 118 at each end of the bow to rotate, feeding out cable and bending limb portions 12 and 14 inward, causing energy to be stored therein. When the bowstring is released with an arrow engaged to the bowstring, the limb portions 12 and 14 return to their rest position, causing idler wheel 16 and cam 118 to rotate in the opposite direction, to take up the bowstring and launch the arrow with an amount of energy proportional to the energy stored in the bow limbs. Bow 10 is described for illustration and context and is not intended to be limiting. The present invention can be used with dual-cam compound bows, or can be used with single-cam bows as described for example in U.S. Pat. No. 5,368,006 to McPherson, hereby incorporated herein by reference. It can also be used with hybrid cam bows or cross bows. The present invention can also be used in other types of bows, which are considered conventional for purposes of the present invention.

Directions referred to herein, such as forwardly, rearwardly, vertically, and horizontally are intended to be from the perspective of an archer holding an archery bow and are not intended to be absolute. The bow is considered to be held in a substantially vertical position for use, with the bowstring and riser generally considered vertical. Forwardly refers to the direction from the bowstring towards the riser in which direction the arrow is intended to leave the bow. Rearwardly refers to the direction extending from the riser towards the bowstring and the archer. Other directional references are intended to apply from this perspective.

Example embodiments of a draw stop system for use on archery bows are illustrated in FIGS. 2-6. For illustration purposes, the systems of FIGS. 2-6 are arranged on cam 118 of archery bow 10. However, it should be appreciated that the present disclosure contemplates use of draw stop systems on various other types of rotational members of archery bows. Additionally, the example embodiments illustrated in FIGS. 2-6 all include a positioner piece (160, 260, 360, 460, 560). However, it should be appreciated that in alternate embodiments the positioner piece may be absent from the draw stop system, with just the abutment piece being used to impede further rotation of the rotational member.

Figure 2:
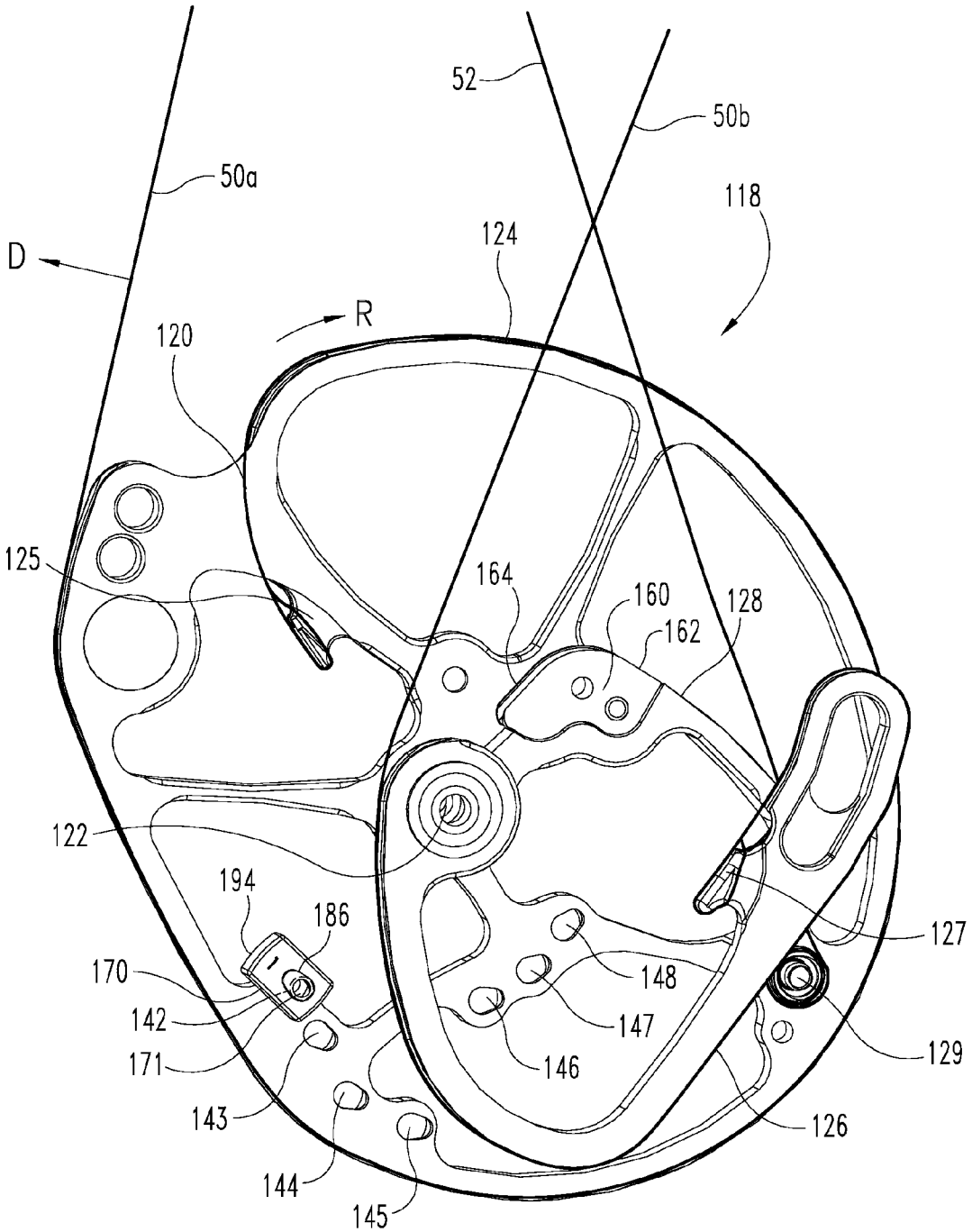
FIG. 2 is a front view of a cam stop assembly according to one embodiment.

As shown in FIG. 2, one example embodiment of a draw stop system according to the present disclosure includes an optional positioner piece 160 and an abutment piece 170, both mounted to cam 118. The abutment piece 170 may also be referred to as a draw stop piece in the present disclosure. As illustrated, in certain embodiments the positioner piece 160 is mounted closer to the cam axle 122 than the piece 170, and the abutment piece 170 is mounted closer to the periphery of cam 118 than piece 160. The abutment piece 170 is arranged on the cam 118 to abut a power cable 52 of the archery bow 10 to prevent further rotation of the cam 118, thereby limiting the draw length of the bowstring 50 of the archery bow. The positioner piece 160 is configured to properly position the power cable 52 so that it contacts the piece 170 upon rotation of the cam, and also assist in defining the amount of allowed rotation of the cam 118 as a result of the length of the groove defined in the piece 160.

As background, the illustrated cam 118 is formed with a body portion 120 upon which are defined one or more cable grooves. The cable grooves may be integral to cam body 120, or may be all or partially formed by elements mounted to the cam body. In the particular illustrated embodiment, cam 118 is configured with three groove portions, including an outer peripheral groove 124, an inner groove 126, and a power cable groove 128. Outer peripheral groove 124 is configured to receive a first portion 50*a* of the bowstring 50, inner groove 126 is configured to receive a second portion 50*b* of the bowstring 50, and groove 128 is configured to receive power cable 52. In the illustrated example embodiment, portion 50*a* of the bowstring 50 is receivable in groove 124 in a let-out arrangement during the bow's draw cycle with an end connected to anchor 125; portion 50*b* of the bowstring 50 is receivable in groove 126 in a let-out arrangement with an end connected to anchor 127; and power cable 52 is receivable in groove 128 in a take-up arrangement with an end connected to anchor 129. Cam 118 may define one or more open areas in body 120 to control weight and balance.

The optional positioner pieces of the present disclosure form part of the path for the power cable. For example, as illustrated in FIG. 2, the cable path from groove 128 extends into a groove defined in the illustrated positioner piece 160. Specifically, positioner piece 160 has an entry groove portion 162 aligned with groove 128 and is curved to define an exit groove portion 164 which is aligned with an abutment surface of the abutment piece 170. During rotation of the cam 118, power cable 52 will take up into groove 128 and into groove portions 162 and 164 as rotation continues. The positioner piece 160 is configured and arranged to properly position the power cable 52 in a manner to present the power cable 52 toward abutment piece 170 upon rotation of the cam 118. In certain embodiments, an imaginary line and/or axis extending out of groove portion 164 runs tangent to and/or abuts a presenting abutment surface on the abutment piece 170. In this way, the piece 160 positions the power cable 52 so that the draw stop piece 160 abuts the cable upon a selected amount of rotation of the cam 118 in order to impede further rotation.

Figure 7:
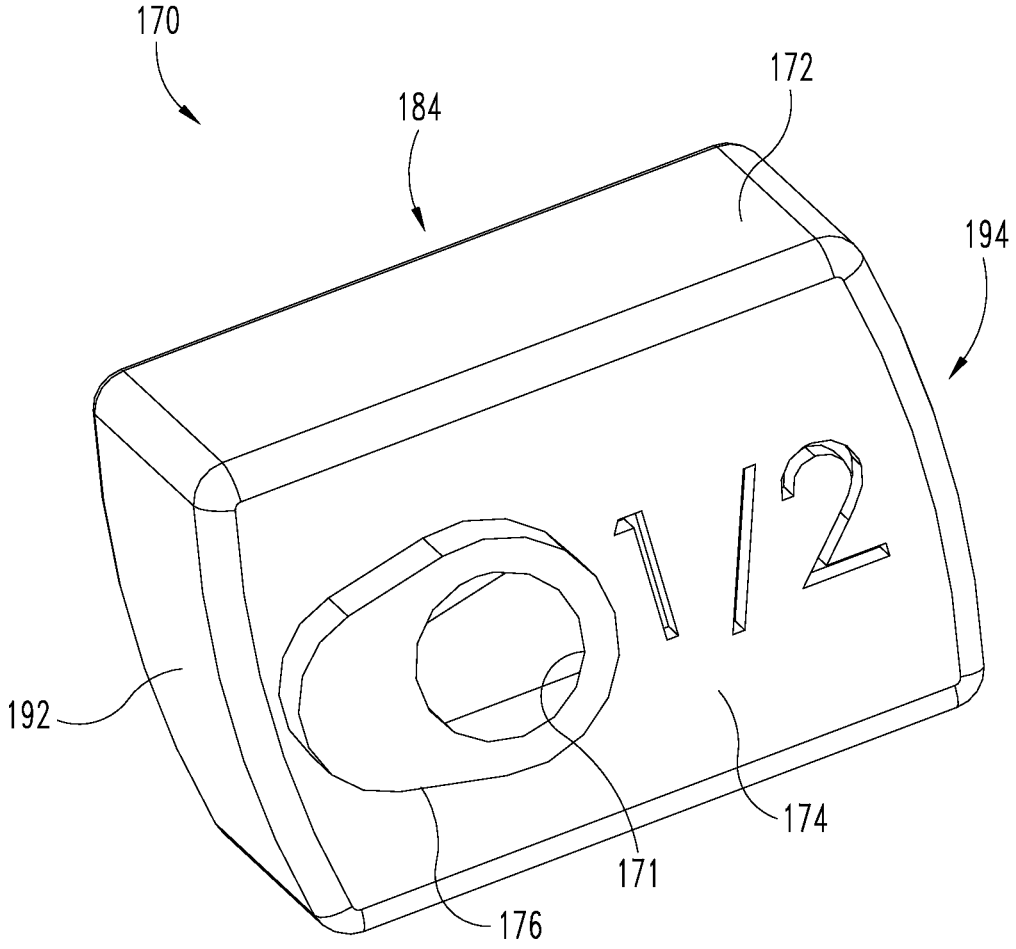
FIG. 7 is a front perspective view of a peripheral cam module piece.
Figure 8:
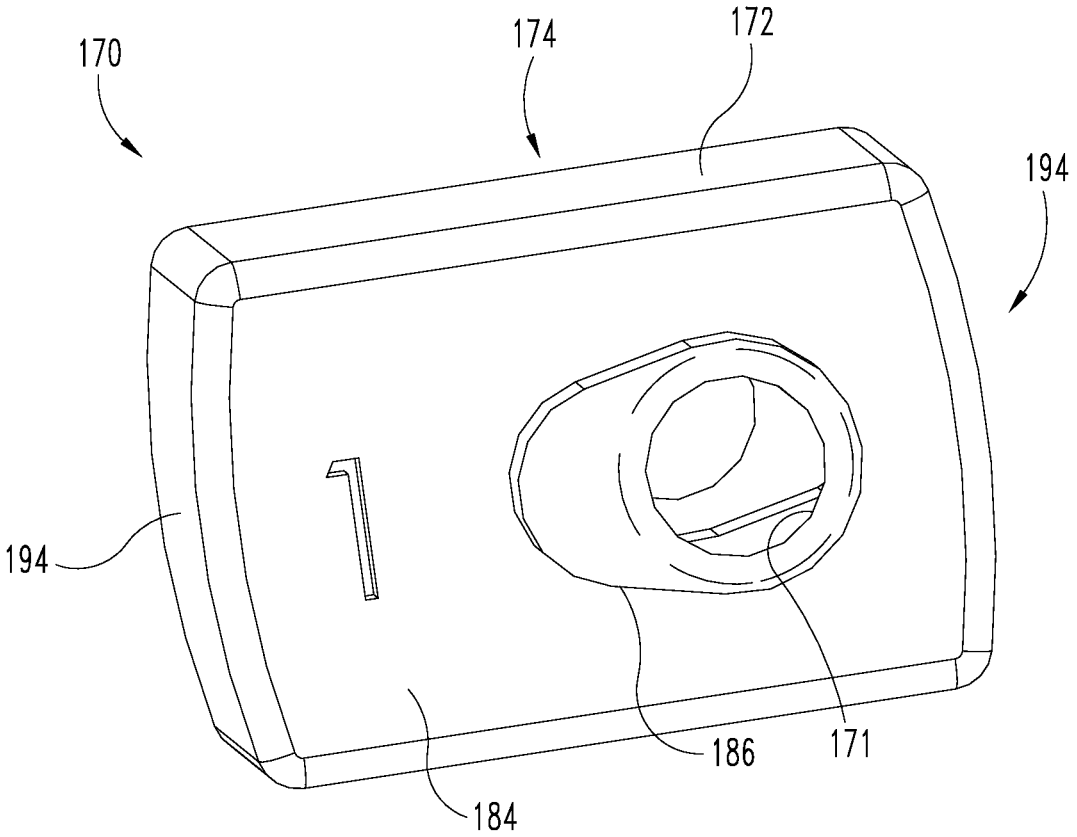
FIG. 8 is a rear perspective view of the peripheral cam module piece of FIG. 7.
Figure 9:
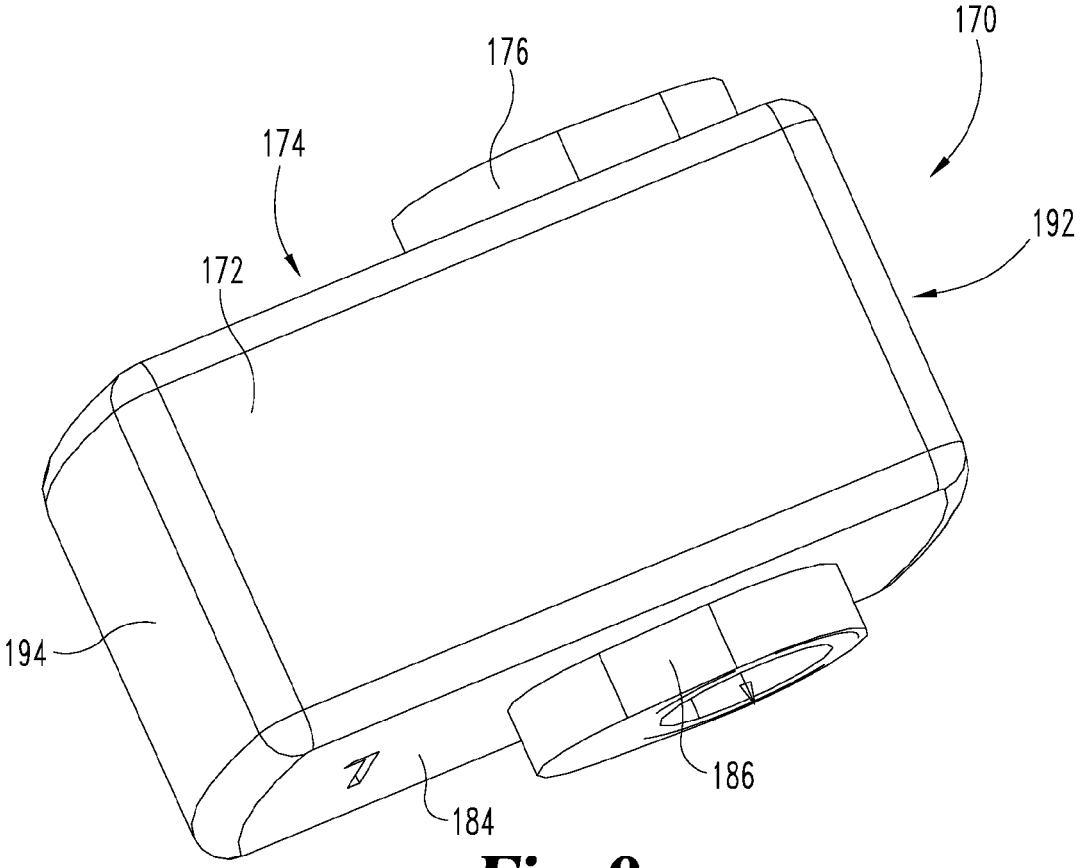
FIG. 9 is a top perspective view of the peripheral cam module piece of FIG. 7.

Turning to the abutment pieces of the present systems, in preferred embodiments the abutment pieces are reversible such that two different draw lengths are possible through the use of a single abutment piece. As illustrated in detail in FIGS. 7-9, the illustrated abutment piece 170 has a body portion 172 defining first and second mounting sides 174 and 184, and corresponding end abutment surfaces 192 and 194. In the particular illustrated embodiments, abutment piece 170 is mounted to cam 118 through the use of mounting lugs 176 and 186 protruding from mounting sides 174 and 184, respectively. The mounting lugs 176 and 186 are received in mounting holes defined in the cam body 120 which are of a corresponding shape. In the particular illustrated embodiments, mounting lugs 176 and 186 are configured to selectively engage one of various mounting holes 142, 143, 144, 145, 146, 147 or 148 defined in cam body 120, creating a modular system as will be discussed in greater detail below. Although mounting lugs are illustrated, it should be appreciated that other mounting protrusions may be used.

The illustrated mounting lugs 176 and 186 are non-symmetric in shape, such that they are configured to be received in one of the mounting holes in a single, specific orientation. The example mounting holes 142-148 are oriented to define specific mounting locations and orientations for abutment piece 170. The use of eccentric and/or non-symmetric fastening mechanisms defines that a selected abutment surface 192 or 194 of mounting piece 170 may only be arranged in one orientation at each mounting location. It should be appreciated that the figures illustrate one example shape for the mounting lugs and correspondingly holes and that alternate non-symmetric fastening shapes and/or mechanisms may be used. Symmetric fastening mechanisms may be used, but are less preferred.

Figure 3:
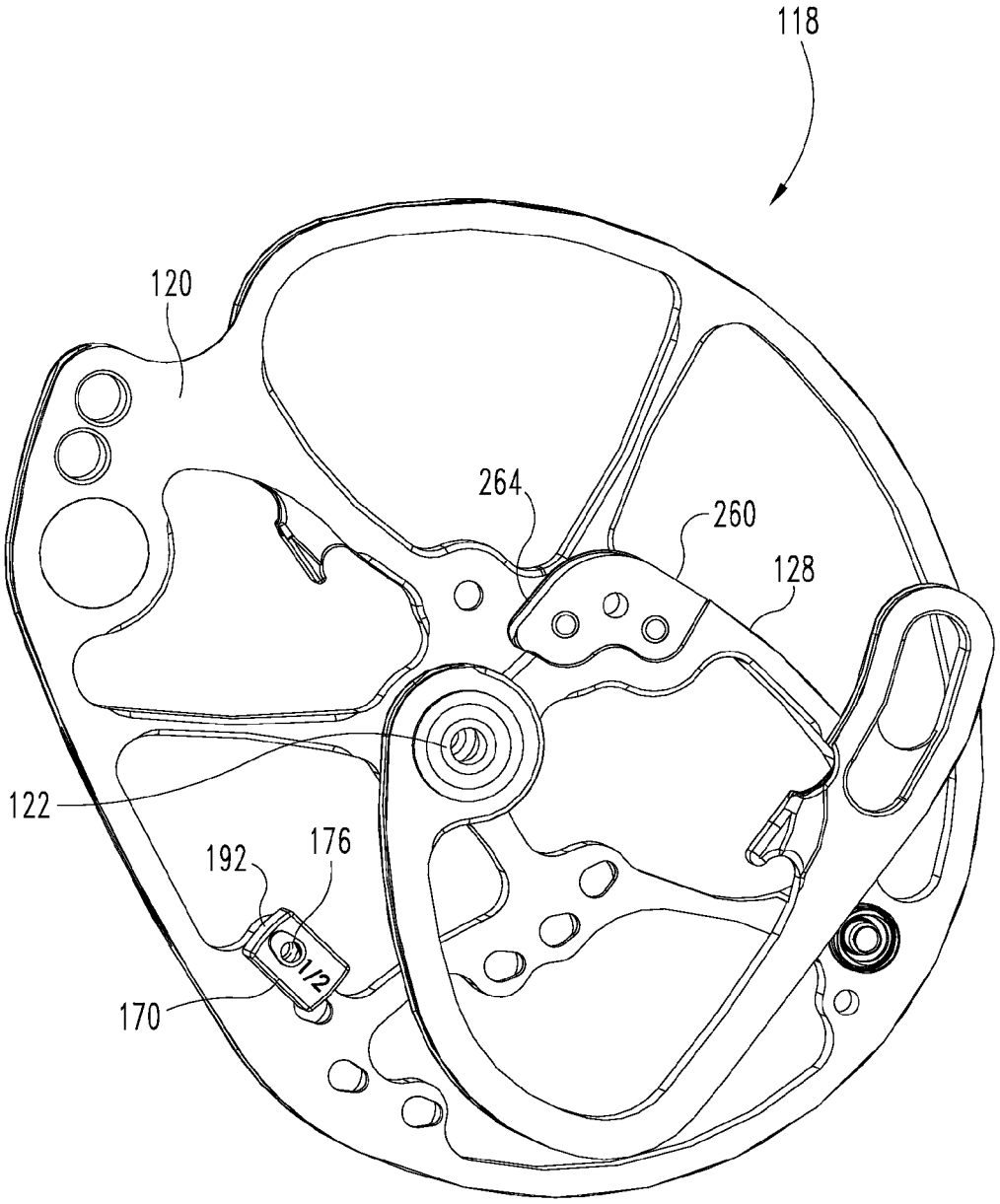
FIG. 3 is a front view of the cam stop assembly of FIG. 2 in an alternate arrangement.
Figure 4:
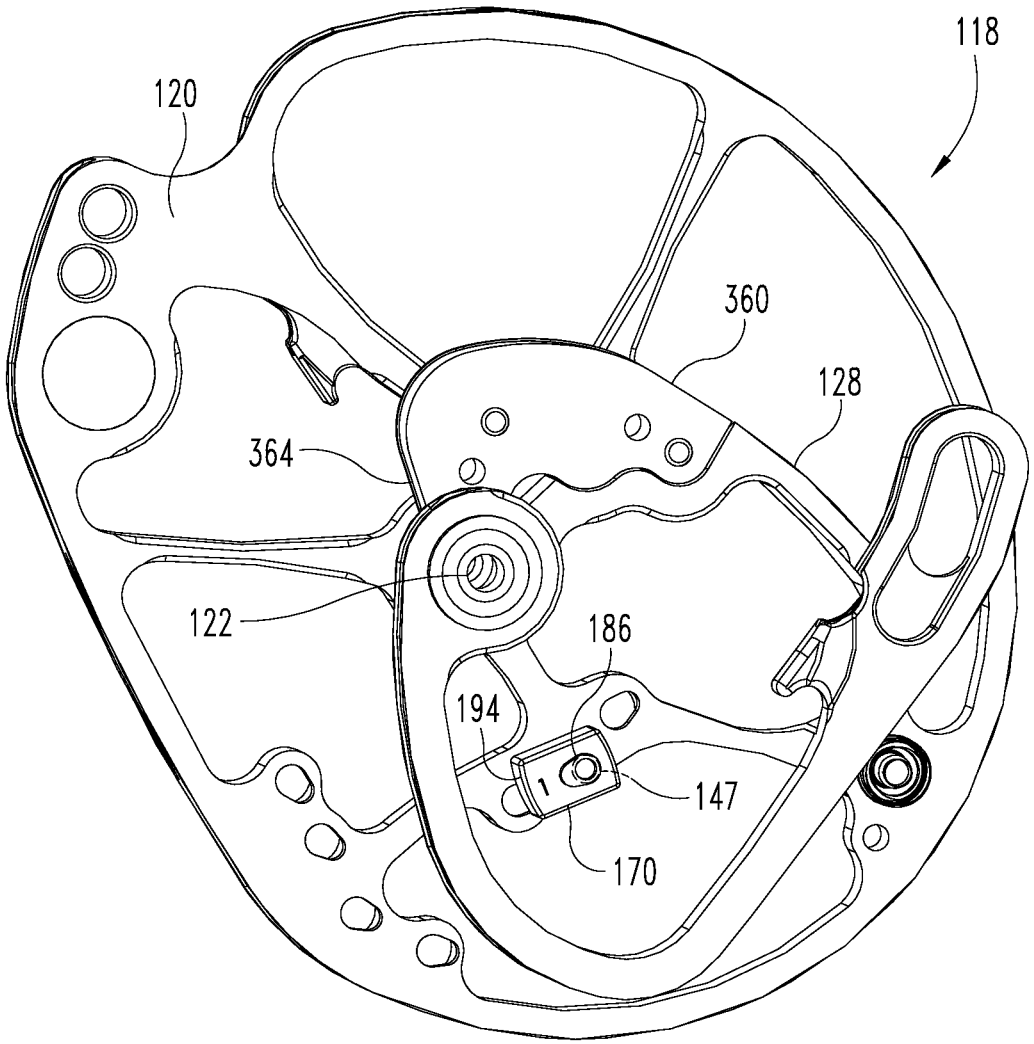
FIG. 4 is a front view of the cam stop assembly of FIG. 2 in an alternate arrangement.
Figure 5:
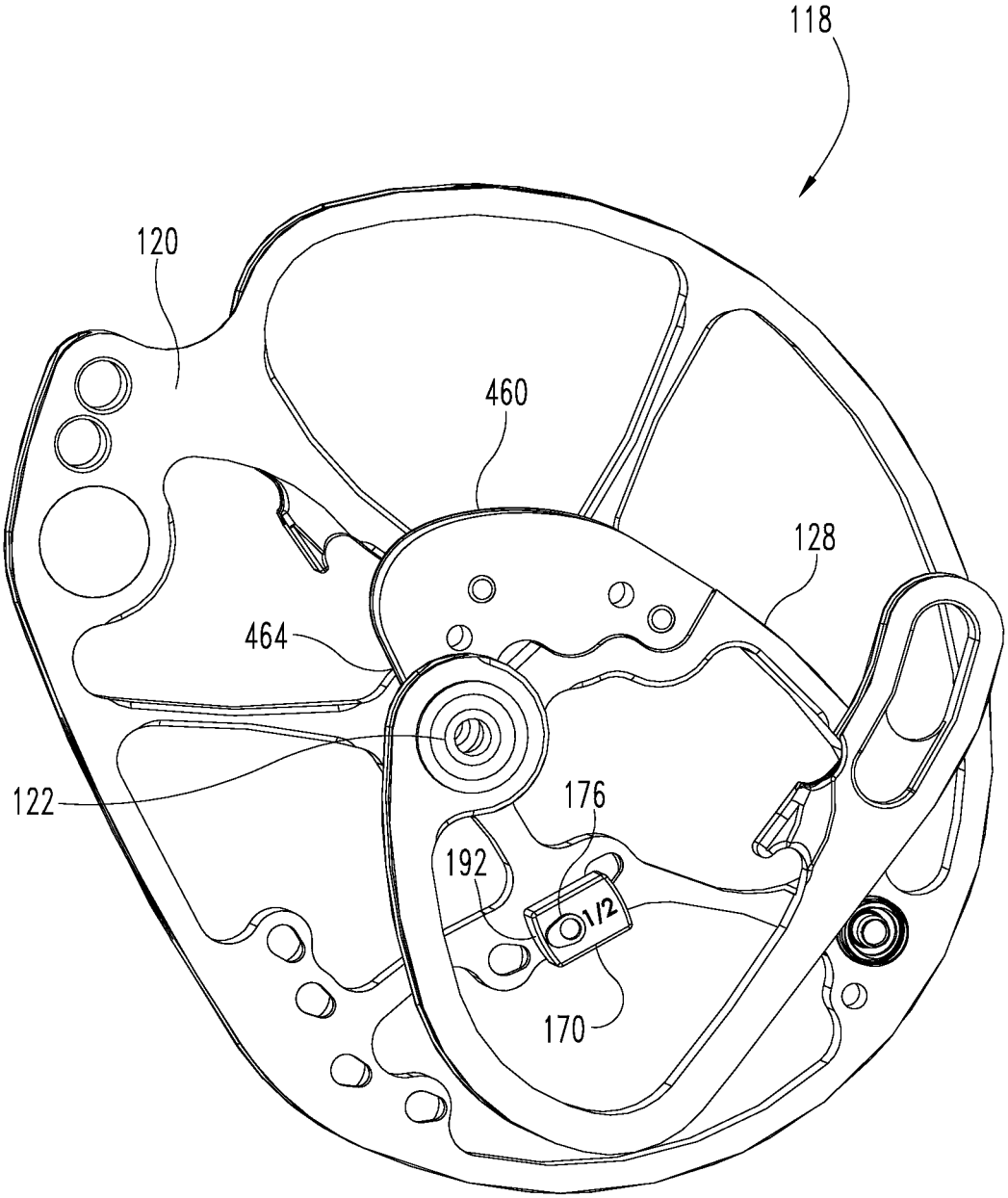
FIG. 5 is a front view of the cam stop assembly of FIG. 2 in an alternate arrangement.

Additionally, in preferred embodiments the mounting lugs 176 and 186 are arranged on opposing sides 174 and 184 at different positions, spacings and/or orientations relative to their corresponding end abutment surfaces 192 and 194. In other words, mounting lug 176 assumes a different orientation with respect to its corresponding abutment surface 194 than the orientation of mounting lug 186 with respect to its corresponding abutment surface 192. In this way, the abutment piece 170 allows for different cam rotation amounts (corresponding to different bowstring draw lengths) depending on which side of piece 170 is mounted facing cam 118. For example as seen in FIG. 2, when piece 170 is mounted to cam 118 with lug 176 engaging a particular mounting point, such as hole 142, abutment surface 194 defines one draw stop position; however, if the abutment piece 170 is turned, for example as seen in FIG. 3, so that lug 186 engages the same mounting hole 142, abutment surface 192 defines a different draw stop position, optionally at a slightly different position than the alternate stop position. In optional embodiments, the abutment surfaces may be formed from or lined with a dampening material.

In certain embodiments, the draw stop systems of the present disclosure may be modular in nature. To accomplish this, the abutment piece 170 may be selectively mounted at various locations on cam body 120. In the particular illustrated embodiment, cam body 120 defines mounting holes 142-148 at which abutment piece 170 may be mounted. For example, in FIGS. 4-5 the abutment piece 170 is mounted at hole 147 and in FIG. 6 the abutment piece 170 is mounted at hole 145. It should be appreciated that the mounting locations may be defined at additional and/or other positions along the cam body 120. As a result of having multiple mounting locations, abutment piece 170 may define two different draw stop positions and corresponding bowstring draw lengths for each mounting location. In other possible embodiments, an abutment piece may be mounted in more than two orientations relative to each mounting location and could thereby define three or more draw stop positions corresponding to each mounting location.

In the optional embodiments in which a positioner piece is also utilized, the particular positioner piece may be configured and/or positioned to match the particular mounting position and orientation of abutment piece 170. As examples, in various arrangements illustrated in FIGS. 2-5, example positioner pieces 160, 260, 360, 460 and 560 are used to match the respective mounting positions and orientations of abutment piece 170. Each of the illustrated positioner pieces is configured and/or positioned differently such that the positioner piece situates the power cable to contact the abutment piece 170 upon rotation of the cam. In each arrangement, preferably lines exiting groove portions 164, 264, 364, 464 and 565 form tangents to and/or abut the particular abutment surface 192 or 194 of abutment piece 170 which is presented toward the power cable. For example as shown in FIG. 2, a cable axis A exiting from groove portion 164 runs tangent to abutment surface 194 of abutment piece 170.

Figure 6:
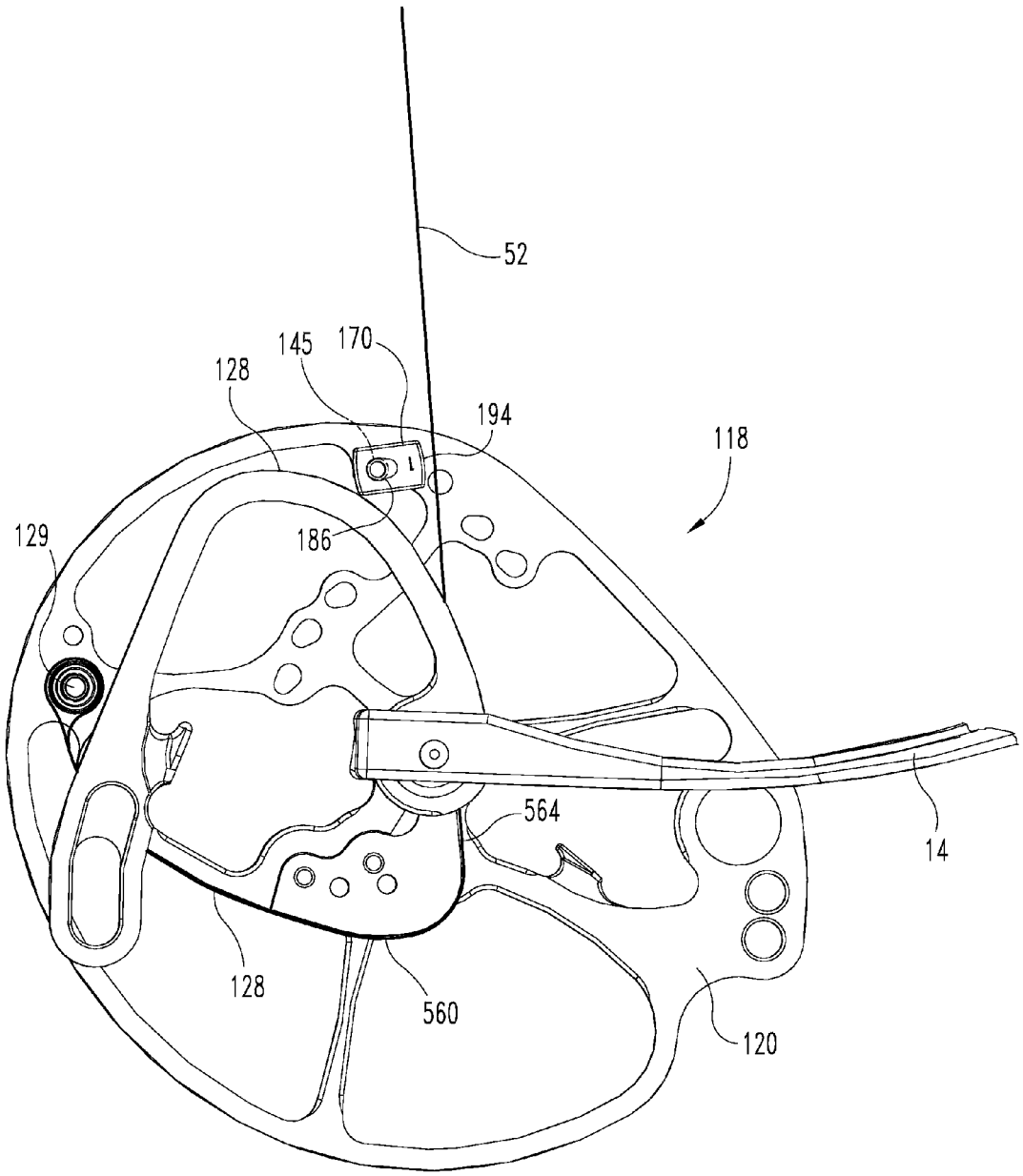
FIG. 6 is a front view of the cam stop arrangement of FIG. 2 with a partial cable illustrated, and with the cam rotated to a stop position.

FIG. 6 provides a further example, illustrating cam 118 rotated to a drawn position. As mentioned above, the power cable 52 has an end connected to anchor 129. Drawing the bowstring 50 of the archery bow 10 along direction D causes clockwise rotation along direction R of cam 118 from the perspective shown (see also FIG. 2), such that power cable 52 wraps around groove 128 and into the periphery groove of central piece 560, exiting out exit groove portion 564. The length of power cable 52 taken-up by positioner piece 560 during rotation of the cam 118 can be controlled by defining the length of the periphery groove of the positioner piece 560. As a result, the length of the groove can assist in defining the amount of allowed rotation of the cam, and thus the allowed draw length of the bowstring—the longer the groove, the more clockwise rotation of the cam that occurs before the power cable contacts the abutment piece. In the fully drawn position, power cable 52 contacts abutment piece 170 and forms a line tangential to both the exit portion 564 of piece 560 and an abutment surface 194 of piece 170. In this way, the abutment of power cable 52 impedes further rotation of cam 118, thereby defining the amount of bowstring draw length allowed by the system.

The abutment piece 170 and the optional positioner piece 160 may be mounted to and/or engaged with cam 118 in a variety of appropriate manners as would generally occur to one of ordinary skill in the art. In the particular illustrated embodiment, a mounting hole 171 extends through piece 170 between lugs 176 and 186. An appropriate fastener, such as a locking pin for example, may be inserted through hole 171 to secure the piece 170 to cam 118. Additionally, in certain embodiments one or more holes defined in the positioner piece 160 are aligned with one or more holes defined in the cam body 120, with appropriate fasteners being used to secure the positioner piece 160 to the cam 118. However, it should be appreciated that abutment piece 170 and positioner piece 160 may be selectively mounted and/or engaged with cam 118 in other appropriate manners as would occur to one of ordinary skill in the art.

Conventional materials may be used to make embodiments of the draw stop systems disclosed. Examples of such materials include metals such as aluminum, steel or titanium or rubber or plastic component pieces as appropriate. As mentioned above, appropriate connectors and fasteners such as screws and pins are used to assemble the cam and its various components, some of which have been illustrated, but not all of which have been discussed in detail. Appropriate use of such connectors as illustrated herein will be understood by those with skill in the art.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An archery bow, comprising:

a riser with a handle;

upper and lower limb portions extending from the riser to limb tip sections;

first and second rotational members supported at the limb tip sections, wherein said first rotational member defines at least one non-symmetric shaped mounting hole;

a bowstring extending between the rotational members;

a power cable anchored at one end to the first rotational member supported at the limb tip section of one of said upper and lower limb portions and anchored at the other end to the opposing limb portion; and, a reversible draw stop piece mounted to the first rotational member, wherein the draw stop piece is configured to abut the power cable when the first rotational member has rotated a preselected amount, resulting from draw of the bowstring, so that the draw stop piece impedes further rotation;

wherein the draw stop piece includes separate, parallel and opposing first and second mounting surfaces mountable facing the first rotational member, wherein the draw stop piece defines a first draw length of the bowstring when the draw stop piece is mounted with the first surface facing the first rotational member and defines a different, second draw length of the bowstring when the draw stop piece is mounted with the second surface facing the first rotational member; and, wherein the first and second mounting surfaces of said draw stop piece each include a mounting protrusion with a non-symmetric shape configured to be received in one of the non-symmetric shaped mounting holes defined in said first rotational member to provide for mounting each surface of said draw stop piece in only a single orientation facing the first rotational member.

2. The archery bow of claim 1, wherein the first rotational member defines a plurality of preselected mounting locations at which the draw stop piece may be mounted, each location corresponding to two different draw lengths of the bowstring defined by the draw stop piece.

3. The archery bow of claim 1, further comprising a cable positioner piece mounted to the first rotational member, wherein the cable positioner piece and the first rotational member each define a groove in which the power cable is configured to be received during rotation of the first rotational member, wherein the cable positioner piece is mounted to the first rotational member such that the grooves in the cable positioner piece and the rotational member are aligned.

4. The archery bow of claim 3, wherein the draw stop piece includes first and second cable abutment surfaces corresponding to the first and second mounting surfaces, respectively, and wherein the cable positioner piece and the draw stop piece are arranged on the first rotational member such that a cable axis extending out of the groove of the cable positioner piece runs tangent to the one of the abutment surfaces arranged to abut the power cable.

5. The archery bow of claim 3, wherein the power cable does not contact the draw stop piece when the bow is undrawn, wherein the cable positioner piece positions the power cable toward the draw stop piece so that the power cable will contact the draw stop piece upon rotation of the first rotational member when the bow is drawn, and wherein the first rotational member includes an axle and the cable positioner piece is mounted closer to the axle than the draw stop piece.

6. The archery bow of claim 3, wherein the power cable does not contact the draw stop piece when the bow is undrawn, and wherein the cable positioner piece is curved and includes an exit portion arranged to present the power cable toward the draw stop piece so that when the power cable engages the exit portion the power cable is positioned to contact the draw stop piece upon rotation of the first rotational member when the bow is drawn.

7. The archery bow of claim 1, wherein the draw stop piece includes first and second cable abutment surfaces corresponding to the first and second mounting surfaces, respectively, and wherein the mounting protrusions are oriented differently on their corresponding mounting surfaces with respect to their corresponding abutment surfaces.

8. The archery bow of claim 1, wherein the mounting protrusions are eccentrically-mounted lugs.

9. A cam stop system configured to be mounted to an archery bow cam, comprising:

a cam for an archery bow, wherein said cam defines at least one non-symmetric shaped mounting hole;

an inner cable positioning piece mountable to the cam; and an outer abutment piece mountable to the cam and configured to engage a power cable of the archery bow to limit the maximum draw length of a bowstring of the archery bow;

wherein the inner cable positioning piece defines a groove in which the power cable is configured to be received during rotation of the cam, and wherein the groove is arrangeable to present the power cable toward the outer abutment piece upon rotation of the cam;

wherein the outer abutment piece includes separate, parallel and opposing first and second mounting sides and is reversible on the cam such that the outer abutment piece defines a first maximum draw length of the bowstring when the first mounting side is facing the cam and defines a different, second maximum draw length of the bowstring when the second mounting side is facing the cam; and, wherein the first and second mounting sides of said outer abutment piece each include a mounting protrusion with a non-symmetric shape configured to be received in one of the non-symmetric shaped mounting holes defined in said cam to provide for mounting each side of said outer abutment piece in only a single orientation facing the cam.

10. The system of claim 9, wherein the outer abutment piece includes first and second cable abutment surfaces corresponding to the first and second sides, respectively, and wherein the inner cable positioner piece and the outer abutment piece are mountable on the cam in an arrangement such that a cable axis extending out of the groove of the inner cable positioner piece runs tangent to the one of the abutment surfaces arranged to abut the power cable.

11. The system of claim 9, wherein the outer abutment piece is arrangeable on the cam to not contact the power cable when the bow is undrawn, wherein the inner cable positioning piece is curved between a cable entry portion and a cable exit portion, and wherein the exit portion is arrangeable to present the power cable toward the outer abutment piece so that when the power cable engages the exit portion the power cable is positioned to contact the outer abutment piece upon rotation of the cam when the bow is drawn.

12. The system of claim 9, wherein the outer abutment piece includes first and second cable abutment surfaces corresponding to the first and second mounting sides, respectively, and wherein the mounting protrusions are oriented differently on their corresponding mounting sides with respect to their corresponding abutment surfaces.

13. The system of claim 9, wherein the mounting protrusions are eccentrically-mounted lugs.

14. A cam of an archery bow, comprising:

a cam body defining at least one groove for receiving a bowstring and at least one groove for receiving a power cable, wherein the cam body defines at least one non-symmetric shaped mounting hole;

a reversible draw stop member mounted to the cam body and configured to engage a power cable of the archery bow to limit the maximum draw length of a bowstring of the archery bow;

wherein the member has a first mounting side corresponding to a first maximum draw length of the bowstring when the member is mounted with the first side facing the cam and a second mounting side corresponding to a different, second maximum draw length of the bowstring when the member is mounted with the second side facing the cam and wherein said first mounting side is separated from and parallel to said second mounting side; and, wherein the first and second mounting sides of said member each include a mounting protrusion with a non-symmetric shape configured to be received in one of the non-symmetric shaped mounting holes defined in said cam body to provide for mounting each side of said member in only a single orientation facing the cam.

15. The cam of claim 14, wherein the cam defines a plurality of preselected mounting locations at which the reversible draw stop member may be mounted, each location corresponding to two different draw lengths of the bowstring allowed by the draw stop member.

16. The cam of claim 14, wherein the reversible draw stop member is arranged on said cam body to not contact the power cable when the bow is undrawn, and further comprising a positioner piece mounted to the cam body, wherein the positioner piece defines a groove in which the power cable is configured to be received during rotation of the cam, wherein the positioner piece is mounted to the cam such that the groove in the positioner piece is aligned with the power cable groove in the cam, and wherein the groove in the positioner piece is arranged to present the power cable toward the draw stop piece so that the power cable contacts the reversible draw stop member upon rotation of the cam when the bow is draw.

17. The cam of claim 16, wherein the draw stop member includes first and second cable abutment surfaces corresponding to the first and second sides, respectively, and wherein the positioner piece and the draw stop member are arranged on the cam such that a cable axis extending out of the groove of the positioner piece runs tangent to the presenting abutment surface.

18. The cam of claim 14, wherein the draw stop member includes first and second cable abutment surfaces corresponding to the first and second mounting sides, respectively, and wherein the spacing between each mounting protrusion and the corresponding abutment surface is different.

* * * * *